US007437994B1

(12) United States Patent
Ratzloff

(10) Patent No.: US 7,437,994 B1
(45) Date of Patent: Oct. 21, 2008

(54) ADHESIVE HINGE STRIPS FOR PRINTER PAPER

(75) Inventor: John Ratzloff, Maple Plain, MN (US)

(73) Assignee: Stone Editions, Inc., Waite park, MN (US)

( * ) Notice: Subject to any disclaimer, the term of this patent is extended or adjusted under 35 U.S.C. 154(b) by 0 days.

(21) Appl. No.: 10/808,085

(22) Filed: Mar. 24, 2004

Related U.S. Application Data

(62) Division of application No. 09/991,521, filed on Nov. 20, 2001, now abandoned.

(60) Provisional application No. 60/249,940, filed on Nov. 20, 2000.

(51) Int. Cl.
*B42F 5/00* (2006.01)

(52) U.S. Cl. ..... 101/483; 40/360; 402/7; 402/79; 402/500

(58) Field of Classification Search ..... 101/483; 400/88; 402/79; 40/359, 360
See application file for complete search history.

(56) References Cited

U.S. PATENT DOCUMENTS 4,207,366 A * 6/1980 Tyler ..... 428/73
4,734,336 A * 3/1988 Oliver et al. ..... 428/537.5
4,911,777 A * 3/1990 Truc et al. ..... 156/252
5,683,194 A * 11/1997 Emmel et al. ..... 402/79
6,071,030 A * 6/2000 Hunter et al. ..... 402/79
6,332,953 B1 * 12/2001 Singh et al. ..... 162/134
6,511,246 B2 * 1/2003 Sapienza et al. ..... 402/79
6,851,718 B2 * 2/2005 Liener Chin et al. ..... 283/36

FOREIGN PATENT DOCUMENTS

| | | |
|---|---|---|
| EP | 0266454 | 11/1988 |
| FR | 2521911 | 8/1983 |
| GB | 0248591 | 3/1926 |
| GB | 0940670 | 10/1963 |
| JP | 2003001891 A * | 1/2003 |

OTHER PUBLICATIONS

"Photography and imaging-Inkjet media: Classification, nomenclature and dimensions", *International Standard ISO 18055-1,* ISO Copyright 2004, Ref. No. ISO 18044-1:2004(E); pp. i-v and 1-14.

* cited by examiner

*Primary Examiner*—Jill E. Culler
(74) *Attorney, Agent, or Firm*—Crompton, Seager & Tufte, LLC.

(57) ABSTRACT

The present invention provides a page for binding in an album. The page includes a blank, printer paper sheet and a hinge strip mounted along an edge of the printer paper sheet, the hinge strip including a flexible line for allowing the hinge strip to bend along the flexible line and a portion for binding to an album. The paper sheet and the hinge strip are adapted to go through a printer together to provide a ready-to-bind printed page.

10 Claims, 2 Drawing Sheets

ADHESIVE HINGE STRIPS FOR PRINTER PAPER

RELATED APPLICATIONS

This application is a divisional of U.S. application Ser. No. 09/991,521 filed Nov. 20, 2001 now abandoned, which claims priority under 35 USC119(e) from U.S. Provisional Application Ser. No. 60/249,940, filed Nov. 20, 2000, which applications are incorporated herein by reference and made a part hereof.

FIELD OF THE INVENTION

This invention relates to the field of image archiving, and more specifically to a printable sheet for mounting in an album.

BACKGROUND

Digital ink jet printing of photography is in the early stages of displacing standard photochemical processing and printing. The trend is growing fastest right now within the professional photography market. Inroads into amateur digital photo printing are also rapidly increasing as scanners, printers and computers drop in price and become more powerful. Many of these prints are intended to be placed, exhibited and bound in or on pages of albums and portfolios. It is desirable to keep these quality prints in good condition for as long as possible.

However, photo books and albums now available for these prints have paper and/or plastic pages. The problem with these include bulky storage, stress on the page when it is turned, and weak bindings. Moreover, the plastic materials used, such as polyvinyl chloride, are easily scratched, highly reflective, expensive, and harmful to photo longevity.

SUMMARY

In one embodiment, the present system provides a page for binding in an album. The page includes a blank, printer paper sheet and a hinge strip mounted along an edge of the printer paper sheet. The hinge strip including a flexible portion for allowing the hinge strip to bend and a mounting portion for mounting the page to an album. The paper sheet and the hinge strip are adapted to go through a printer together to provide a ready-to-bind printed page. In one option, the hinge and paper materials meet the highest technical photo and book conservation specifications.

Among other advantages, the present invention provides a system for producing a digital, ready-to-bind photograph in which the image is the page.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
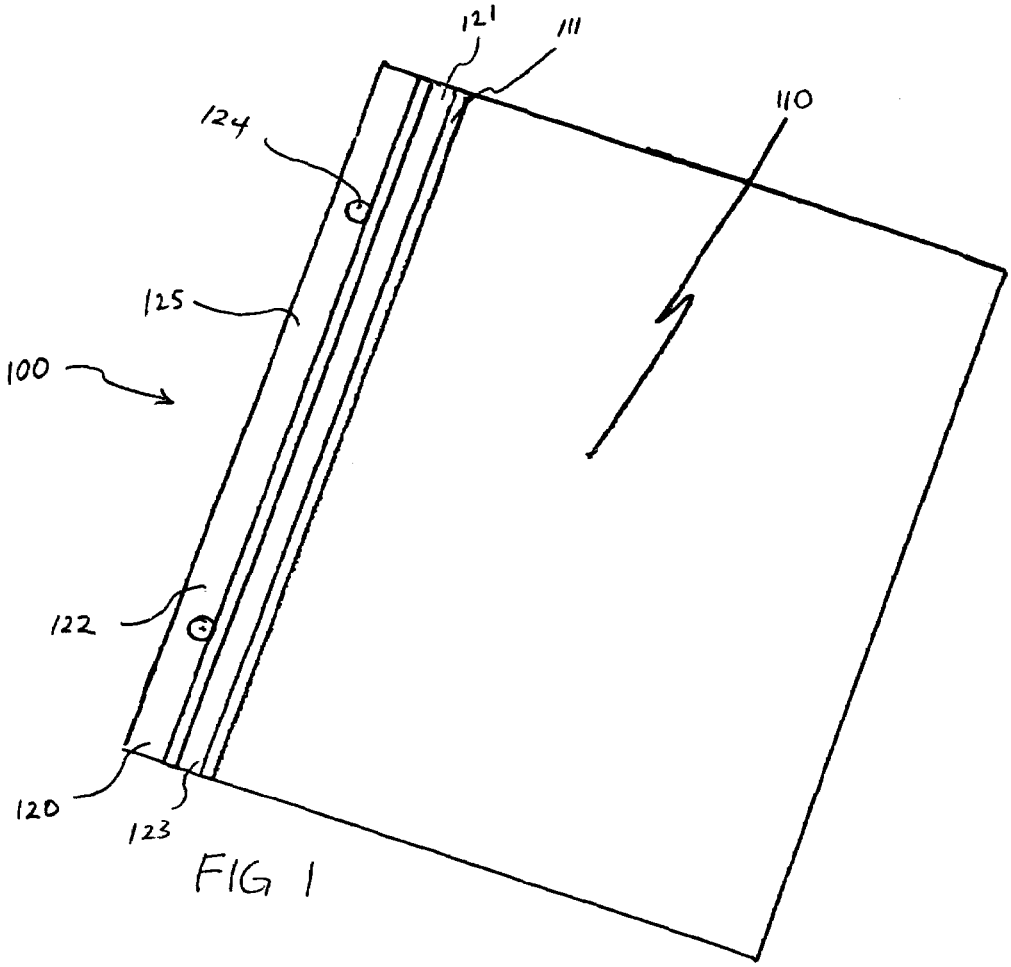
FIG. 1 shows a perspective view of a page in accordance with one embodiment of the present invention.
Figure 2:
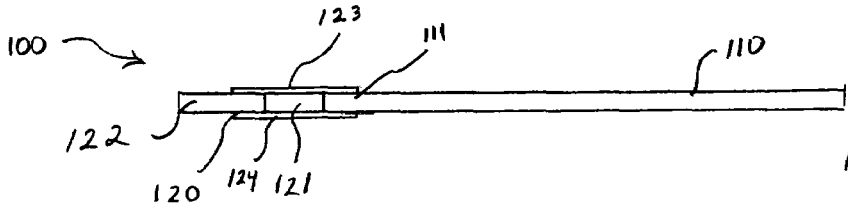
FIG. 2 shows an end view of the page of FIG. 1.

FIG. 1 shows a perspective view of a page 100 in accordance with one embodiment of the present invention. FIG. 2 shows an end view of page 100. Page 100 produces a ready-to-bind print in which the image is the page.

Page 100 includes a blank, printer paper sheet 110 and a hinge strip 120 mounted along an edge 111 of the printer paper sheet.

In one example, sheet 110 is a rectangular sheet of ink jet paper adapted for being printed by a digital ink jet printer. As used herein, blank means that the sheet is adapted for having an image printed thereon. For example, the sheet can have watermarks, a printed border, or other pre-printed design and still be considered blank within the scope of the present system. In one example, sheet 110 includes an uncoated, unbleached, 100% cotton rag. Being uncoated, ink is absorbed into the paper by billions of fine cotton fibers. The image, therefore, becomes integral to the paper. Such a paper provides cotton inkjet prints which are extremely resilient, remaining in good condition even after use and handling. In one example, ADAMANT brand paper is used for sheet 110. ADAMANT brand paper can be ordered from Stone Editions, Inc. (St. Cloud, Minn.). The specifications of ADAMANT brand paper include: 100% cotton rag fiber, 90 lb. weight, cold extract pH: 7.5-8.0 (acid free), buffer: calcium carbonate; reserve: 1.5-1.9% by weight, lignin free, color fast, and no optical brighteners.

Hinge strip 120 is attached along edge 111 of sheet 110 and is designed to serve as a flexible hinge allowing the hinged page 100 to feed through an ink jet printer mechanism while also allowing a printed page 100 to turn flat and lie flat when bound. In one embodiment, hinge strip 120 includes a mounting strip 122 and a pair of flexible connecting strips 123 and 124.

Mounting strip 122 is for mounting or binding page 100 to an album. In this example, mounting strip 122 includes a ¾" wide, 24 point solid bleached acid-free paper strip. Strip 122 has a mounting portion 125 which can be drilled or die cut with two or more ¼" holes 124 to accommodate binding posts and extensions, as a method to bind the page into album covers. In other embodiments, holes 124 can be omitted and the page can be mounted to a C-clamp type binder, for example.

In one example, connecting strips 123 and 124 include ⅞" wide strips of linen or polyofin carrier film (tape) coated with acrylic adhesive. Strips 123 and 124 are applied back to back to edge 111 of sheet 110 and to mounting strip 122. In this embodiment, the connecting strips 123 and 124 are attached so that there is a ⅜" space between sheet 110 and strip 122. In other embodiment, the gap size can vary as necessary. However, a ⅜" gap is conducive to stress-free page turning and pages that turn and lie flat when bound, especially as quantities of pages are added to the binding. The space between sheet 110 and strip 122 defines a flexible portion 121 allowing hinge strip 120 to bend without causing bending in attached sheet 110.

In one example, the polyofin or linen material and acrylic adhesive of hinge 120 combine to yield a totally "archival" binding that will never dry out, yellow, become brittle, crack, or tear. The adhesive is also "reversible" meaning the binding can be intentionally removed from the paper with minimal heat (hair dryer or tacking iron). This quality allows the page to meet strict museum conservation specifications and requirements. Thus allowing a user to make ready-to-print-and-bind album, portfolio and scrapbook pages which meet the highest technical preservation standards (American National Standards Institute and American Society for Testing Materials).

In one example of manufacturing page 100, a page-making machine is provided which incorporates a series of roll unwind stands which provide unwinding and in-line dispensing of roll-fed paper in various widths, two rolls of linen or polyofin acrylic adhesive tape for connecting strips 123 and 124, and a roll of ⅞" wide 20-24 point solid bleached board for mounting strip 122.

The page-making machine unwinds the materials, and aligns the four webs of component materials such that a strip of adhesive is applied onto both the front and the back sides of one edge of the paper and the solid bleached mounting strip to provide a two-sided taping process, whereby the flexible hinge 120 is created and is pressed together through a pinch-roller to create a continuous web style page.

As the final processes, the hinged paper is cut at right angles to the hinge to create single pages 100 of various lengths. The cut-off process is achieved by the use of a guillotine style cut-off blade. Once the hinged-bound page is cut to a specified length, two or more holes are centered and die cut on the ⅞" 20-24 point solid bleached strip. Spacing of the holes is adjustable.

Figure 3:
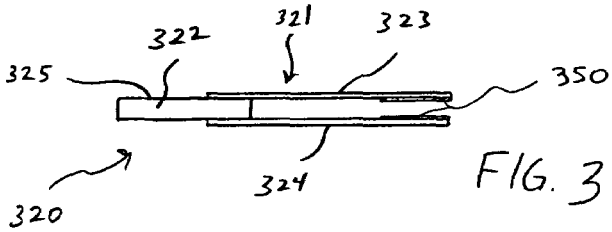
FIG. 3 shows a end view of a hinge strip in accordance with one embodiment.

FIG. 3 shows a end view of a hinge strip 320 in accordance with one embodiment. Hinge strip 320 is an after-market or user applied hinge strip. A user can apply hinge strip 320 either before or after an image is printed on a sheet such as sheet 110.

In this example, hinge strip 320 includes a mounting strip 322 and a pair of connection strips 323 and 324 attached to an edge of strip 322 and overhanging the edge of strip 322. Strip 322 has an album mounting portion 325 and can include mounting holes similar to mounting strip 122 described above. Connection strips 323 and 324 are similar to strips 123 and 124 discussed above and are for mounting to an edge of a printer paper sheet. Each strip 323 and 324 includes an adhesive portion having a release liner 350 covering over the adhesive until a user remove the release liner. A user can apply hinge strip 320 to a sheet of paper such that a flexible line gap 321 is created. Thus, hinge strip 320 includes a flexible portion such that when the hinge strip is mounted to a printer paper sheet the hinge strip is bendable along the flexible line.

Figure 4:
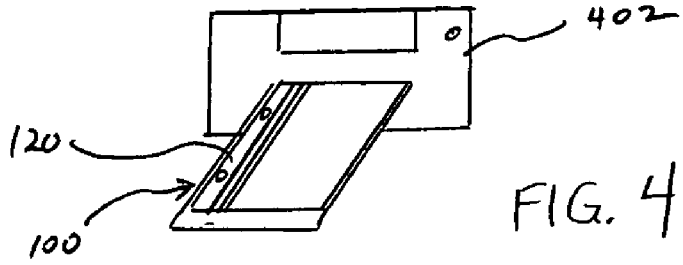
FIG. 4 shows an example use of the page of FIG. 1.

FIG. 4 shows an example use of page 100 on a desktop printer 402. In this example, sheet 110 and hinge strip 120 are attached together and dimensioned to go through a printer together as page 100 to provide a ready-to-bind printed page. In one example, positioning the image on the page is accomplished by setting up a document in a computer imaging computer program to the same dimensions as the pages to be printed and then setting a guide 1½" from the left side of the document. This compensates for the width of the binding and allows proper positioning of the images within the line area of the page.

To print the page, page 100 is placed in printer 402's paper holding tray with hinge strip 120 oriented vertically. The flexible materials of hinge strip 120 do not disrupt the printer's paper feed mechanism during the printing process.

Figure 5:
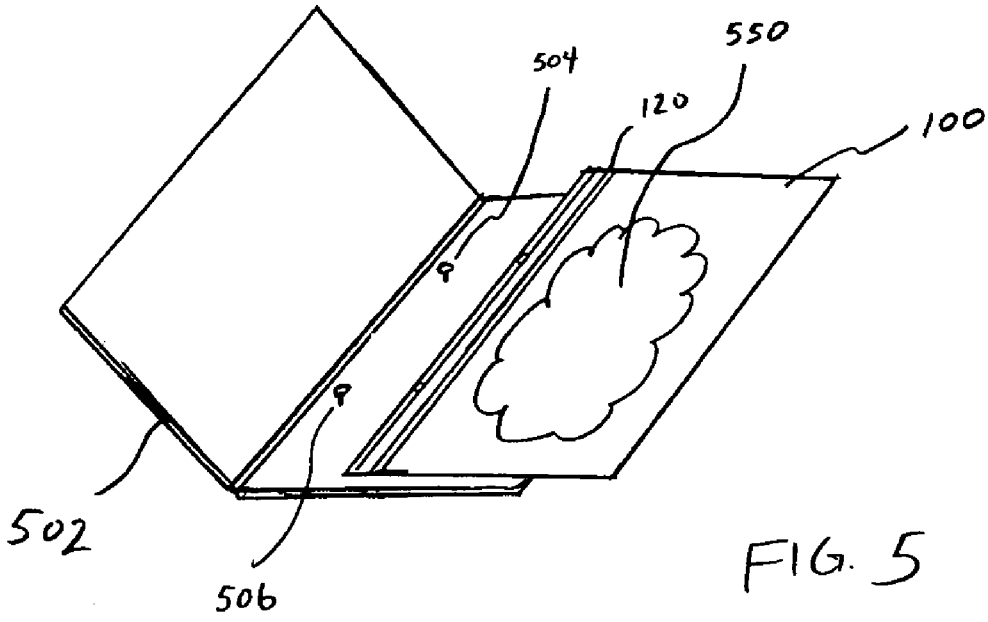
FIG. 5 shows the page of FIG. 1 after it is printed and ready for mounting in an album.

FIG. 5 shows a page 100 after an image 550 is printed and the page is ready for mounting in an album 502. Image 550 can be text, figure, picture digital photo, etc. When bound to posts 504 and 506, pages 100 turn smoothly and lie flat for excellent viewing. In one embodiment, hinge strip 120 is clear, offering no visual clutter to distract from the print. Pages 100 are easily added, removed and rearranged for album 502. Since the pages are the images, no mounting adhesives or expensive, reflective and scratch prone plastic sleeves are necessary.

Accordingly, the present invention improves archivability and preservation of digital ink jet prints by providing top quality paper having a 100% acid free hinge for mounting the paper within an album.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A method comprising:

providing an assembly of a blank sheet and a hinge strip, the hinge strip including a mounting strip having a plurality of mounting holes therein and first and second connecting strips, the first and second connecting strips formed of a dissimilar material from the mounting strip, wherein the first connecting strip is a separate component from the second connecting strip, the mounting strip spaced apart by a gap from the edge of the blank sheet, the first connecting strip having a first end portion adhesively attached to a first side of the mounting strip and having a second end portion adhesively attached to the blank sheet along a first side of the blank sheet and spanning the gap between the mounting strip and the blank sheet, and the second connecting strip having a first end portion adhesively attached to a second side of the mounting strip and having a second end portion adhesively attached to the blank sheet along a second side of the blank sheet and spanning the gap between the mounting strip and the blank sheet;

sending the assembly through a printer to print a photographic image on the blank sheet; and mounting the assembly in an album using the mounting strip.

2. The method of claim 1, wherein the blank sheet is cotton rag paper material.

3. The method of claim 1, wherein the blank sheet is an uncoated, unbleached paper.

4. The method of claim 1, wherein the blank sheet is a 100% cotton fiber, acid-free paper.

5. The method of claim 1, wherein sending the assembly through the printer to print an image on the sheet includes printing an image such that the image becomes integral with the paper.

6. The method of claim 1, wherein sending the assembly through the printer to print an image on the sheet includes sending the assembly through a desktop digital printer.

7. The method of claim 1, wherein mounting the assembly in an album includes using the mounting holes.

8. The method of claim 1, wherein the gap has a width in the range of about 0.375 inches.

9. The method of claim 1, wherein the blank sheet comprises a photo-grade material.

10. A method of providing a ready-to-bind photo sheet, the method comprising:

providing a blank photo-grade sheet, a mounting strip, a first connecting strip formed of a first strip of flexible polymeric film, and a second connecting strip formed of a second strip of flexible polymeric film discontinuous from the first strip of flexible polymeric film, the mounting strip formed of a dissimilar material from the first and second connecting strips;

positioning the mounting strip along an edge of the blank sheet and spaced apart by a gap from the edge of the blank sheet, the mounting strip including a plurality of mounting holes for mounting the assembly in a photo album, and adhesively attaching the first connecting strip formed of a flexible polymeric film along a first side of the blank sheet;

adhesively attaching the first connecting strip to the mounting strip along a first side of the mounting strip, such that the first connecting strip spans the gap between the mounting strip and the blank sheet;

adhesively attaching the second connecting strip formed of a flexible polymeric film along a second side of the blank sheet; and adhesively attaching the second connecting strip to the mounting strip along a second side of the mounting strip, such that the second connecting strip spans the gap between the mounting strip and the blank sheet.

* * * * *